US011719140B1

(12) United States Patent
Palazzolo et al.

(10) Patent No.: US 11,719,140 B1
(45) Date of Patent: Aug. 8, 2023

(54) INTERNALLY ASSEMBLED POSITIVE CRANKCASE VENTILATION VALVE

(71) Applicant: FORD GLOBAL TECHNOLOGIES, LLC, Dearborn, MI (US)

(72) Inventors: Christopher Palazzolo, Ann Arbor, MI (US); Erzabeth J. Holcombe, Northville, MI (US); Kristofor Robert Norman, Canton, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 17/901,762

(22) Filed: Sep. 1, 2022

(51) Int. Cl.
*F01M 13/00* (2006.01)
*F02M 35/10* (2006.01)

(52) U.S. Cl.
CPC .. *F01M 13/0011* (2013.01); *F02M 35/10222* (2013.01)

(58) Field of Classification Search
CPC .. F01M 13/0011; F01M 13/00; F01M 13/023; F02M 35/10222
See application file for complete search history.

(56) References Cited

U.S. PATENT DOCUMENTS 4,169,432 A 10/1979 White
4,602,607 A 7/1986 Balsley
4,667,647 A * 5/1987 Ohtaka ..... F01M 13/023 123/573
5,499,604 A 3/1996 Ito et al.
6,095,105 A 8/2000 Lohr et al.
6,161,513 A 12/2000 Lohr et al.
8,205,604 B2 6/2012 Velosa et al.
8,919,329 B2 12/2014 Lohr et al.
9,556,767 B2 1/2017 Newman et al.

FOREIGN PATENT DOCUMENTS

CN 103615296 3/2014
JP 2000110538 4/2000

* cited by examiner

*Primary Examiner* — Jacob M Amick
(74) *Attorney, Agent, or Firm* — Vincent Mastrogiacomo; Brooks Kushman P.C.

(57) ABSTRACT

A crankcase ventilation system is disclosed that includes a PCV valve, a spigot and a tube connector. The PCV valve is enclosed in a module housing that encloses a plunger, and a spring. The module housing defines an inlet opening, and an outlet opening and is assembled inside an engine component. The spigot is attached to an outer surface of the engine and is in fluid communication with the PCV valve through the outlet opening. The tube connector is in fluid communication with the tube connector and the PCV valve. An intake manifold of the engine provides vacuum to the PCV valve, through the tube, the tube connector and the spigot. If one of the tube, tube connector, or spigot is detached from the engine, the PCV valve is retained in the engine and is held closed by the spring biasing the plunger against the inlet opening.

16 Claims, 2 Drawing Sheets

INTERNALLY ASSEMBLED POSITIVE CRANKCASE VENTILATION VALVE

TECHNICAL FIELD

This disclosure relates to internal combustion engines that include a positive crankcase ventilation valve (PCV valve).

BACKGROUND

On Board Diagnostic (OBD) emission regulations require detection of a PCV valve being disconnected or broken off of a cam cover or other engine component that creates a leak of crankcase gases. Externally mounted PCV valves may break away from the engine but the PCV valve may remain attached to the PCV tube potentially creating an opening in the crankcase to atmosphere where the valve has broken away. If the PCV valve remains attached to the PCV tube, the PCV valve may cap the PCV tube and the monitoring system (which is downstream of the PCV tube) will not detect that the PCV valve is broken. In the event of a valve breakaway from the engine, conventional PCV valve designs may remain attached to the PCV tube connector and result in an undetectable condition and an OBD emission deficiency.

This disclosure is directed to solving the above problems and other problems as summarized below.

SUMMARY

According to one aspect of this disclosure, an apparatus is provided for a crankcase ventilation system that includes a PCV valve, a spigot and a tube connector. The PCV valve is enclosed in a module housing and is assembled inside an engine. The module housing encloses a plunger, and a spring. The module housing defines an inlet opening, and an outlet opening. The spigot is attached to the engine and is in fluid communication (gaseous fluid) with the PCV valve through the outlet opening. The tube connector is attached to the spigot and a tube, wherein the tube connector is in fluid communication with the tube and the PCV valve. An intake manifold is connected to the tube and provides vacuum from the intake manifold to the PCV valve, through the tube, the tube connector, and the spigot. In the event that one of the tube, tube connector, or spigot is detached from the engine, the PCV valve module is retained in the engine and is held closed by the spring biasing the plunger against the inlet opening.

The above apparatus may also include additional, alternative, and optional features. One such feature is a cap received on the housing that defines the outlet opening. The spigot may include a base that is attached to an end of the spigot that engages the cap as assembled. The base of the spigot separates from the cap of the module housing when the spigot is detached. When one of the tube, tube connector, and spigot is detached, a leak is created that is detectable by a test conducted downstream from the PCV valve and upstream from the intake manifold of the engine. The PCV valve is preferably assembled to the engine inside a cam cover. The base of the spigot is separable from the cap of the module housing. The spigot may be assembled to the engine on an outer surface of the cam cover.

According to a second aspect of this disclosure, an apparatus is disclosed that includes an engine and a crankcase ventilation system that circulates crankcase vapors. The crankcase ventilation system circulates vapors from the engine to a PCV valve that is enclosed in the engine. The crankcase ventilation system connects the PCV valve to an intake manifold through a spigot, a tube connector, and a tube that are all located outside the engine. If one of the tube, tube connector, and spigot is detached from the engine, the PCV valve disposed inside the engine is held in its closed position.

The second aspect of this disclosure may also include additional, alternative, and optional features. The apparatus may include a cap received on the housing that cap defines the outlet opening. A base may be attached to an end of the spigot that faces the cap when assembled, so that when the spigot is detached from the engine the base of the spigot separates from the cap of the module housing. The base of the spigot is adapted to separate from the cap of the module housing when the spigot is detached. When the spigot, the tube connector, or the tube is detached, a leak is created in the system that is detectable by a test conducted downstream from the PCV valve and upstream from the intake manifold of the engine. The PCV valve may be assembled to the engine inside a cam cover and the spigot may be assembled to the engine on an outer surface of the cam cover.

According to additional, alternative, and optional aspects of this disclosure, a system is disclosed that includes an engine, a PCV valve, and a conduit assembly. The PCV valve is assembled inside an opening defined by a component of the engine. The conduit assembly is in fluid communication with an outlet opening of the PCV valve and is attached to an outer surface of the engine. The conduit is open to a vacuum from the intake manifold and provides vacuum to the PCV valve that acts on a plunger of the PCV valve to open the PCV valve when sufficient vacuum is provided. The PCV valve closes if the conduit assembly is detached from the engine and the PCV valve seals the opening defined by the component of the engine.

According to other optional or alternative aspects of this disclosure as it relates to the disclosed system, a leak in the system may be detected in the event the conduit is detached from the PCV valve. The conduit assembly may include a spigot, a tube connector, and a tube. The PCV valve is opened by vacuum provided by an intake manifold that is in fluid communication with the PCV valve through the conduit assembly. The conduit assembly may be assembled to an outer surface of the engine component and is in fluid communication with the PCV valve that is assembled inside the engine component. The PCV valve may include a housing that is assembled inside a cam cover of the engine and that defines an inlet opening, and an outlet opening, and wherein the housing encloses a plunger, and a spring. The spigot may be attached to the outer surface of the engine component.

The above aspects of this disclosure and other aspects will be described below with reference to the attached drawings.

DETAILED DESCRIPTION

Figure 1:
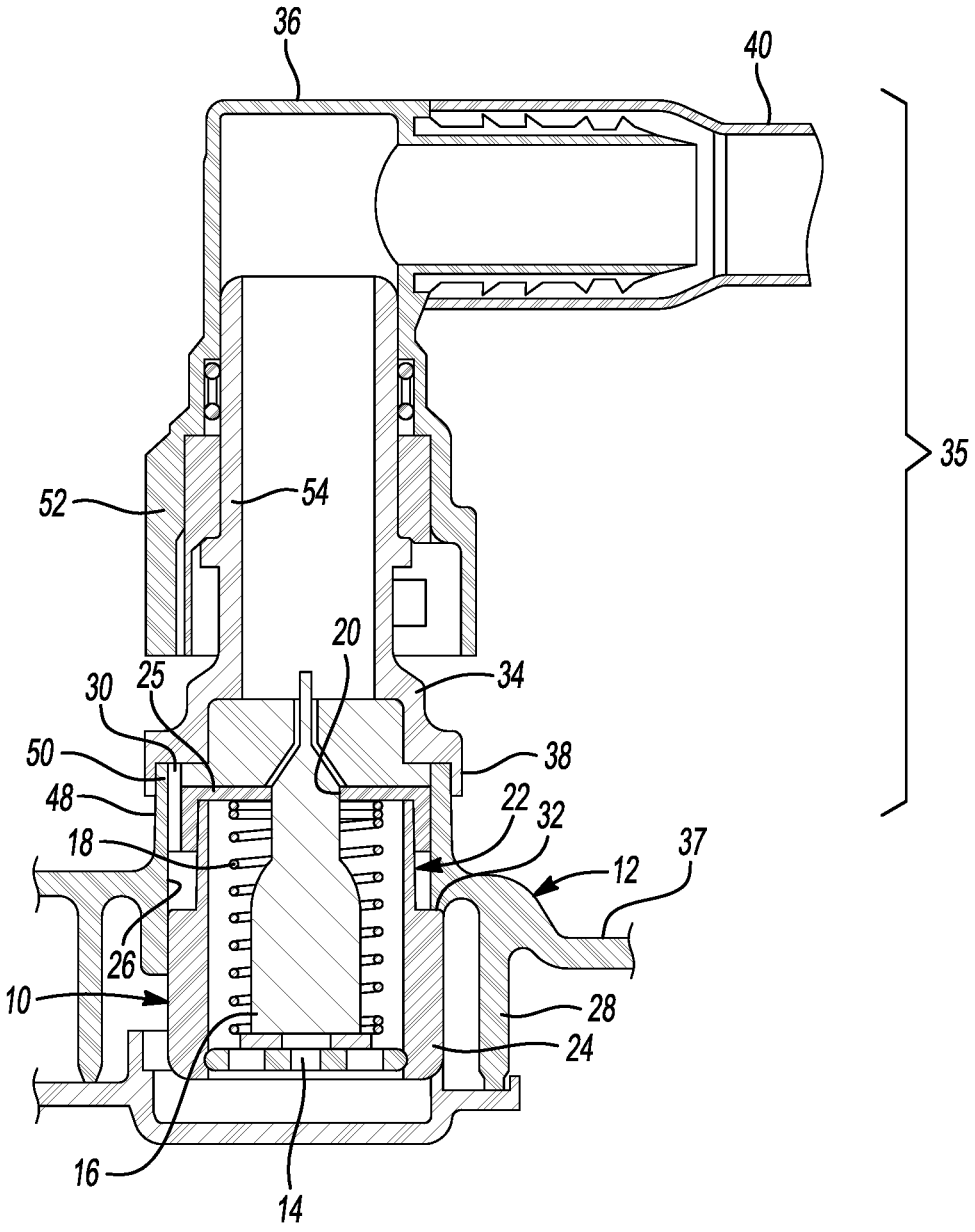
FIG. 1 is a fragmentary diagrammatic cross-section view of a PCV valve module internally assembled to a cam cover with a spigot and a tube connector attached to the PCV valve module external to the cam cover.

The illustrated embodiments are disclosed with reference to the drawings. However, it is to be understood that the disclosed embodiments are intended to be merely examples that may be embodied in various and alternative forms. The figures are not necessarily to scale, and some features may be exaggerated or minimized to show details of particular components. The specific structural and functional details disclosed are not to be interpreted as limiting, but as a representative basis for teaching one skilled in the art how to practice the disclosed concepts.

Various features illustrated and described with reference to any one of the figures may be combined with features illustrated in one or more of the other figures to produce embodiments that are not explicitly illustrated or described. The combinations of features illustrated provide representative embodiments for typical applications. Various combinations and modifications of the features consistent with the teachings of this disclosure could be used in particular applications or implementation.

"One or more" includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Figure 2:
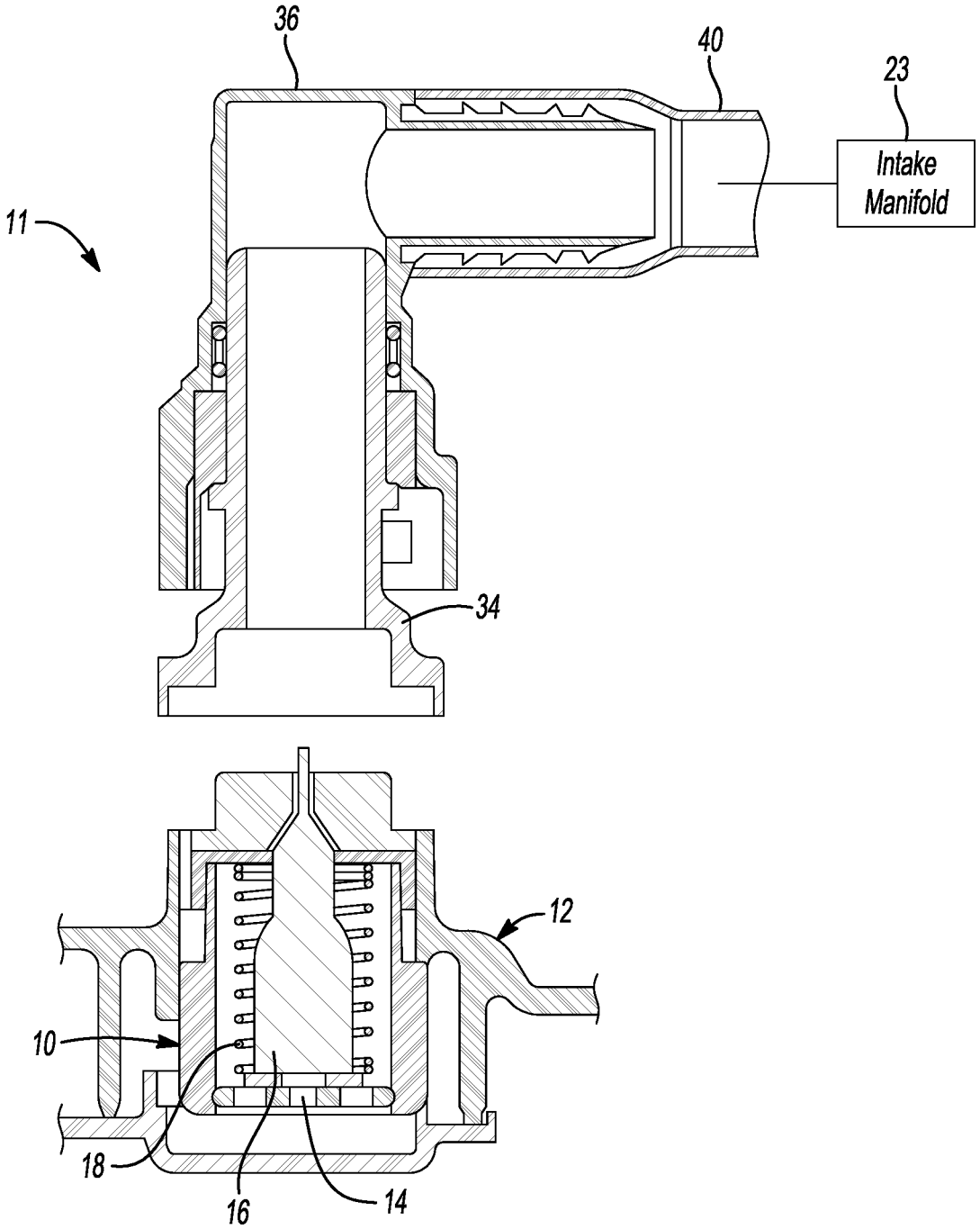
FIG. 2 is a fragmentary diagrammatic cross-section view of a PCV valve module internally assembled to a cam cover with a spigot and a tube connector detached from the PCV valve.

Referring to FIGS. 1 and 2, a PCV valve module 10 is shown that is part of a closed crankcase ventilation system that directs crankcase vapors, including air and products of combustion that "blow by" the piston rings (hereinafter vapors), produced back to the intake manifold to be added to the flow of intake air and combusted by the engine 12. Vapor and air from the crankcase is drawn through the intake manifold into the engine valve compartment and the crankcase. The vapors and air are drawn through the PCV valve module 10 and into the intake manifold. The vapors are then mixed with the air-fuel mixture and burned in the combustion process. If the flow of crankcase vapor is not controlled, the air-fuel mixture ratios may be upset.

During idle, when decelerating, and at low speeds, less vapor is burned and the vacuum in the intake manifold is very high and closes off the metered opening, or outlet opening 20. When operating at normal loads and speeds, the vacuum level in the intake manifold drops. The PCV valve is opened further and thereby increases the volume of vapor sent back to the intake manifold. During acceleration or heavy loading, the intake manifold vacuum is very low, and the PCV valve is opened to the maximum extent maximizing the crankcase vapor sent to the intake manifold 23.

The PCV valve module 10 includes an inlet opening 14, a plunger 16, a spring 18, and a metered outlet opening 20 that are contained in a module housing 22. The PCV valve module 10 receives vapors from the crankcase (not shown) that are drawn by vacuum in an intake manifold 23 of the engine 12 when the PCV valve is opened the vapors are drawn into the intake manifold 23 through various connecting conduits as explained below.

The module housing 22 is a cylindrical housing that includes a cap 25 that defines the outlet opening 20. The module housing 22 includes external ribs 24 that are received in slots 26 formed on the cam cover 28 that retain the module housing 22 inside the engine component. The module housing 22 is retained in an internal cavity 30 defined by the engine component, or cam cover 28. The PCV valve module 10 is locked by a lip 32 provided on the engine component, or cam cover 28, that engages one or more of the external ribs 24. Other interlocking elements may be substituted for the external ribs 24 and the slots 26 (e.g., a bayonet connection, interlocking threaded elements, and the like).

The PCV valve module 10 is retained inside the engine 12 and, more specifically, inside the cam cover 28. A spigot 34 and tube connector 36 may be referred to as a conduit assembly 35 and are not part of the 10 module and are not disposed inside the engine 12. The spigot 34 is attached to an outer surface 37 of the engine 12, or cam cover 28, and includes retention features 38 (such as lips, ridges, interlocking elements, or the like) that retain the spigot 34 on the engine 12. The spigot 34 includes a base 39 that abuts the PCV valve module 10. The tube connector 36 is assembled to the spigot 34 and a tube 40. The tube 40 extends to the intake manifold 23 of the engine 12.

The spigot 34 includes a retaining feature 38, or skirt, that is assembled over an outer surface 48 of a circular flange 50 of the cam cover 28.

The tube connector 36 includes a shroud 52 that receives an upper portion 54 of the spigot 34. As shown, the tube connector 36 is L-shaped with one leg receiving the tube 40 and the other leg receiving the spigot 34.

Referring more specifically to FIG. 2, an example is illustrated wherein the spigot 34 is detached from the engine 12. The crankcase ventilation system may also be breached by detaching the tube connector 36 from the spigot 34 or by the tube 40 being detached from the tube connector 36. As used herein, detaching an element from another element of the crankcase ventilation system also includes fracturing or breaking one or more of the elements.

For any number of reasons, the spigot 34 may become detached from the engine 12. If the spigot 34 is detached the PCV valve module 10 that is assembled inside the engine 12, or engine component remains connected to the engine 12 and the plunger 16 closes the PCV valve module 10 as a result of the spring 18 biasing the plunger 16 to close the inlet opening 14. With the spigot 34 detached from the engine 12 no vacuum is provided to the 10 and no vacuum pressure is available to counter the biasing action of the spring 18.

The tube connector 36 may also become separated from the spigot 34. If the tube connector 36 is detached from the spigot 34, the spigot 34 may or may not also be detached from the engine 12. In either event, the PCV valve module 10 remains intact inside the engine 12. Again, the plunger 16 holds the PCV valve module 10 closed as a result of the spring 18 biasing the plunger 16 to close the inlet opening 14. With the spigot 34 detached from the engine 12 no vacuum is provided to the PCV valve module 10, and no vacuum pressure is available to counter the biasing force of the spring 18.

The tube 40 may be detached from the tube connector 36 leaving the tube connector 36 and spigot 34 attached to the engine 12. The 10 remains inside the engine 12 and continues to function to keep the crankcase ventilation system sealed. The spring 18 biases the plunger 16 to its closed position because there is no vacuum available from the intake manifold 23 to counter the spring 18.

By assembling the PCV valve module 10 inside the engine 12, the PCV module 10 cannot be damaged or detached from the engine 12. The PCV valve module 10 is protected inside the engine from damage.

In leak tests of the closed crankcase ventilation system a leak test analyzer is placed in the system downstream from the PCV valve and upstream from the intake manifold 23. If a prior art PCV valve is detached from the engine the PCV valve will remain closed. The closed PCV valve prevents detection of the opening in the system created when the PCV valve is detached. This is considered to be a failure of the leak test because the leak test analyzer will fail to detect the opening in the closed crankcase ventilation system. In such systems, if the PCV valve is detached, the crankcase will be open to atmosphere and the vapors will be released as emissions from the engine 12.

The embodiments described above are specific examples that do not describe all possible forms of the disclosure. The features of the illustrated embodiments may be combined to form further embodiments of the disclosed concepts. The words used in the specification are words of description rather than limitation. The scope of the following claims is broader than the specifically disclosed embodiments and includes modifications of the illustrated embodiments.

What is claimed is:

1. An apparatus comprising:

a PCV valve assembled inside an engine, the PCV valve including a module housing that encloses a plunger, and a spring, and wherein the module housing defines an inlet opening, and an outlet opening;

a spigot attached to the engine and in fluid communication with the PCV valve through the outlet opening;

a tube connector attached to the spigot and a tube, the tube connector is in fluid communication with the tube and the PCV valve; and an intake manifold connected to the tube, wherein vacuum from the intake manifold is provided to the PCV valve, through the tube, the tube connector and the spigot, and wherein when one of the tube, tube connector, and spigot is detached, the PCV valve is retained inside the engine and is held closed by the spring biasing the plunger against the inlet opening, wherein when the spigot is detached, the base of the spigot separates from the cap of the module housing.

2. The apparatus of claim 1 further comprising:

a cap received on the module housing, wherein the cap defines the outlet opening.

3. The apparatus of claim 2 wherein the spigot includes a base that is attached to an end of the spigot that engages the cap as assembled.

4. The apparatus of claim 1 wherein when one of the tube, tube connector, and spigot is detached, a leak is created that is detectable by a test conducted downstream from the PCV valve and upstream from the intake manifold of the engine.

5. The apparatus of claim 1 wherein the PCV valve is assembled to the engine inside a cam cover.

6. The apparatus of claim 5 wherein the spigot is assembled to the engine on an outer surface of the cam cover.

7. An apparatus comprising:

an engine; and a crankcase ventilation system that circulates crankcase vapors, the crankcase ventilation system circulates the vapors from the engine to a PCV valve module that is enclosed in the engine, the crankcase ventilation system connects the PCV valve module to an intake manifold that provides vacuum to the PCV valve module through a spigot, a tube connector, and a tube that are all located outside the engine, and wherein if one of the tube, tube connector, and spigot is detached, the PCV valve module is retained in the engine and is held closed, wherein the PCV valve module includes a cap received on a module housing, wherein the cap defines an outlet opening, wherein a base attached to an end of the spigot engages the cap, and wherein when the spigot is detached, the base of the spigot separates from the cap of the module housing.

8. The apparatus of claim 7 wherein when one of the spigot, tube connector, and tube is detached, a leak is created that is detectable by a test conducted downstream from the PCV valve module and upstream from the intake manifold of the engine.

9. The apparatus of claim 7 wherein the PCV valve module is assembled to the engine inside a cam cover.

10. The apparatus of claim 7 wherein the spigot is assembled to the engine on an outer surface of the cam cover.

11. A system comprising:

an engine;

a PCV valve module assembled inside an opening defined by an engine component;

a spigot attached to the engine and in fluid communication with the PCV valve through an outlet opening; and a conduit assembly including a spigot, a tube, and a tube connector is in fluid communication with the outlet opening of the PCV valve module attached to an outer surface of the engine, the conduit is open to a vacuum from an intake manifold and provides the vacuum to the PCV valve, the vacuum acts on a plunger of the PCV valve module to open when sufficient vacuum is provided depending upon engine operation, and wherein the PCV valve module closes if the conduit assembly is detached from the engine and the PCV valve module seals the opening defined by the engine component, wherein when the spigot is detached, a base of the spigot separates from a cap of the PCV valve module.

12. The system of claim 11, wherein a leak in the system can be detected when the conduit assembly is detached from the PCV valve.

13. The system of claim 11, wherein the PCV valve module is opened by vacuum provided by an intake manifold that is in fluid communication with the PCV valve module through the conduit assembly.

14. The system of claim 11, wherein the PCV valve module includes a housing that is assembled inside a cam cover of the engine, wherein the housing defines an inlet opening and an outlet opening, and wherein the housing encloses a plunger and a spring.

15. The system of claim 14, wherein the spigot is attached to the outer surface of the engine component.

16. The system of claim 11, wherein the conduit assembly is assembled to the outer surface of the engine component and is in fluid communication with the PCV valve module that is assembled inside the engine component.

* * * * *